US005865201A

United States Patent [19]

Lin

[11] Patent Number: 5,865,201

[45] Date of Patent: Feb. 2, 1999

[54] UMBRELLA

[76] Inventor: Chen-Hsiung Lin, No. 174, Pi Tan Village, Lu Tsao Hsiang, Chia Yi Hsien, Taiwan

[21] Appl. No.: 56,887

[22] Filed: Apr. 8, 1998

[51] Int. Cl.[6] ..... A45B 25/00

[52] U.S. Cl. ..... 135/31; 135/33.7; 135/25.2

[58] Field of Search ..... 135/25.2, 25.3, 135/25.31, 25.32, 26, 29, 31, 32, 33.7

[56] References Cited

U.S. PATENT DOCUMENTS

| | | | |
|---|---|---|---|
| 177,339 | 5/1876 | Kirkham . | |
| 212,457 | 1/1879 | Girbardt . | |
| 573,375 | 12/1896 | Whitney . | |
| 855,142 | 5/1907 | Steininger . | |
| 1,052,954 | 2/1913 | Podmaniczky . | |
| 3,374,798 | 3/1968 | Samuelson . | |
| 3,853,136 | 12/1974 | Schwartzenberg | 135/25.2 X |
| 4,984,599 | 1/1991 | Hwang | 135/26 X |
| 5,193,565 | 3/1993 | Huang | 135/25.2 |
| 5,305,770 | 4/1994 | DeMarco | 135/26 |
| 5,482,069 | 1/1996 | Lee | 135/31 |

*Primary Examiner*—Lanna Mai
*Attorney, Agent, or Firm*—Rosenberg, Klein & Bilker

[57] ABSTRACT

An umbrella includes an improved frame consisting of ribs, stretchers, stretcher extensions and position members, and then assembled with a support rod, a lower panel and an upper panel. The ribs, the stretchers and the stretcher extensions are assembled together with the position members and pivots so as to become collapsible and extensible to form two layers of panels. The upper panel and the lower panel form a gap between them for a wind to blow out. The combination of the upper panel and lower panel coupled to the finish frame for preventing collapse of the umbella when a wind force is applied.

1 Claim, 8 Drawing Sheets

UMBRELLA

BACKGROUND OF THE INVENTION

This invention relates to an umbrella, particularly to one having a flowing gap between an upper panel and a lower panel for a wind to blow through so as to prevent the parasol from swaying or falling down.

Nowadays, leisure activity is very popular, and a family often goes out for a picnic at a beach or other recreational resorts. If the sunlight is strong during summertime, an umbrella is indispensable for keeping cool from he sunlight. Common conventional umbrellas in use shown in FIG. 8 include a metal rod 10, a number of stretchers 20 disposed pivotally on an upper portion of the metal support rod 10 and extending in a radial direction, and the same number of ribs 30 as the stretchers 20 pivotally connected to the upper end of the metal rod at their upper ends and pivotally connected to the outer ends of the stretchers 20 at their intermediate portions. Then a panel 40 is disposed on the ribs 30, collapsible together with the ribs 30 and the stretchers 20 relative to the metal support rod 10.

However, the conventional umbrella has a large large panel 40, liable to sway around if there is a wind and may fall down if worse, causing possible wounds to persons if there should be any below the umbrella.

SUMMARY OF THE INVENTION

A purpose of the invention is to offer an umbrella not swaying or falling down even if there is a rather strong wind.

A main feature of the invention is a number of ribs, a number of stretchers and a number of stretcher extensions pivotally combined together by means of position members and pivots to make a collapsible frame for disposing an upper panel and a lower panel to form a gap between the two panels for a wind to blow through so as to keep the whole umbrella from swaying or falling down.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
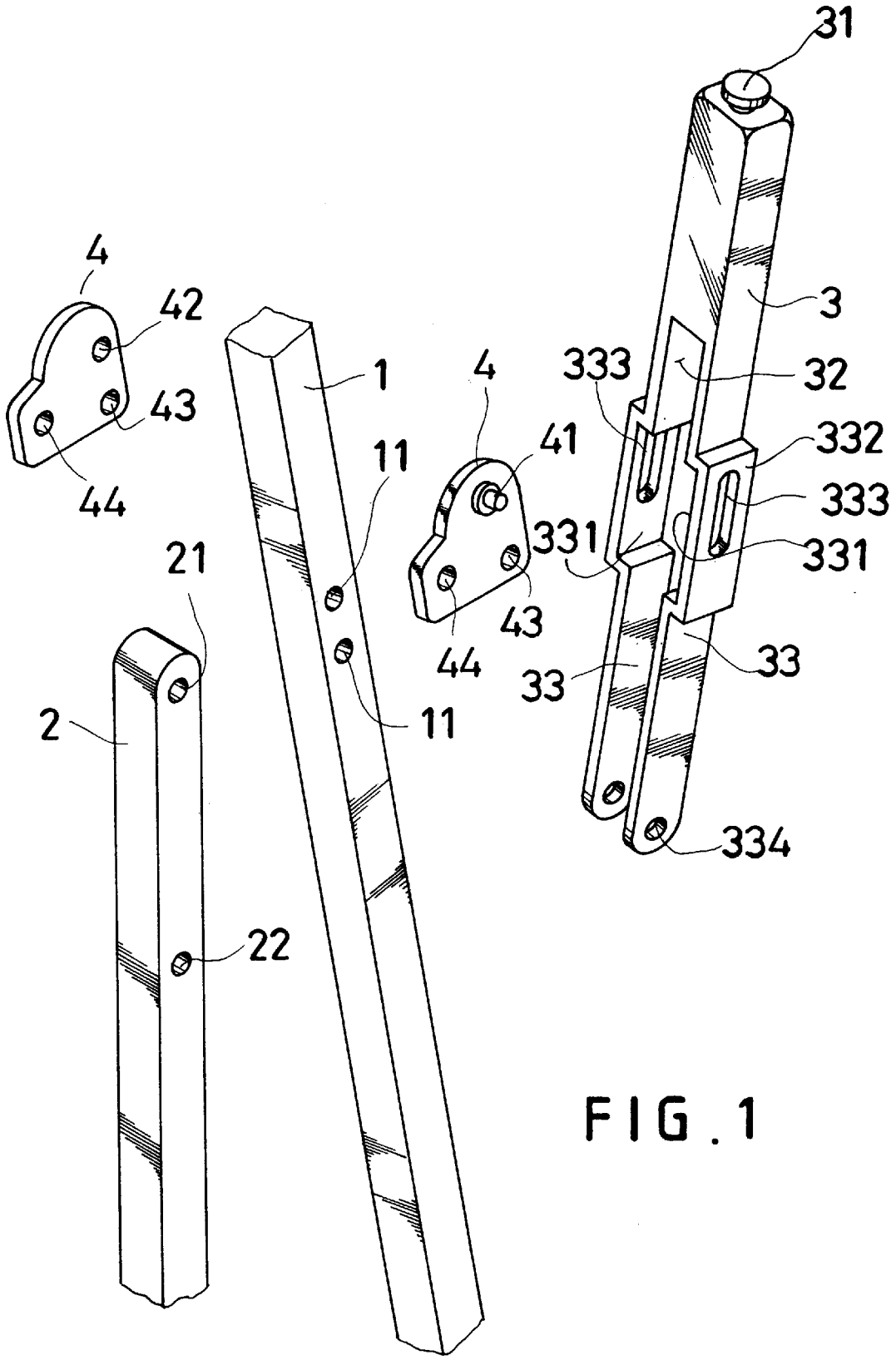
FIG. 1 is an exploded perspective view of an umbrella of the present invention.

A preferred embodiment of an umbrella in the present invention, as shown in FIG. 1, includes a number of ribs 1, a number of stretchers 2, a number of stretcher extensions 3 and a number of position members 4, a number of fixing means 5, an upper panel 6, a lower panel 6', a number of pivots 7 and a support rod 8 as components assembled together.

Each rib 1 has two lateral fix holes 11 spaced apart vertically in an upper portion for fixing means 5 to fit through.

Each stretcher 2 has a pivot hole 21 at an upper end and a pivot hole 22 at an intermediate portion for respectively combining a position member 4 and a stretcher extension 3.

Each stretcher extension 3 has a round stud 31 with a lower annular groove on an upper end for a string of the lower panel 6 to be bound around, an opening 32 formed in an intermediate portion and a lower portion defined by two long plates 33, and having respectively a recess 331 defined by a projecting-out wall 332. Each projecting-out wall 332 has a lengthwise slot 333. Each long plate 33 has a pivot hole 334 in a lower end for connecting pivotally each stretcher extension 3 with each stretcher 2.

Each position member 4 is shaped as a plate, having a sidewise projection 41 on an outer side fitting in the slot 333 of each stretcher extension 3, two holes 42, 43 in a right side corresponding to the fix holes 11 of each rib 1, and a through hole 44 in a left side corresponding to the pivot hole 21 of each stretcher 2 for a pivot 7 to fit in.

Figure 2:
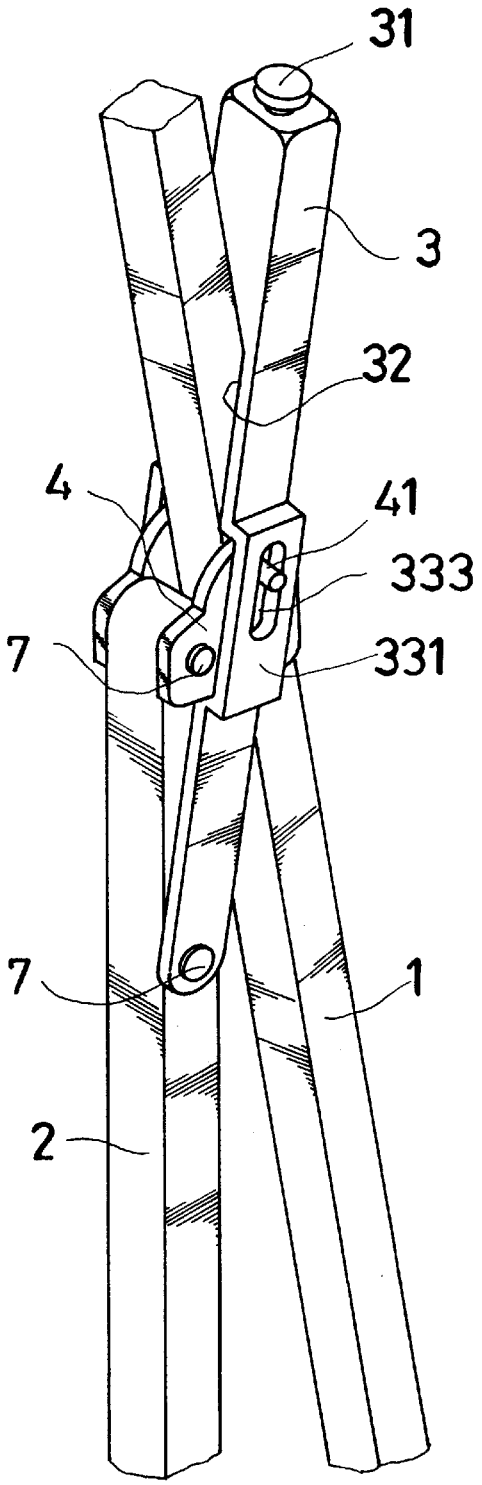
FIG. 2 is a perspective view of a frame of the umbrella of the present invention.
Figure 3:
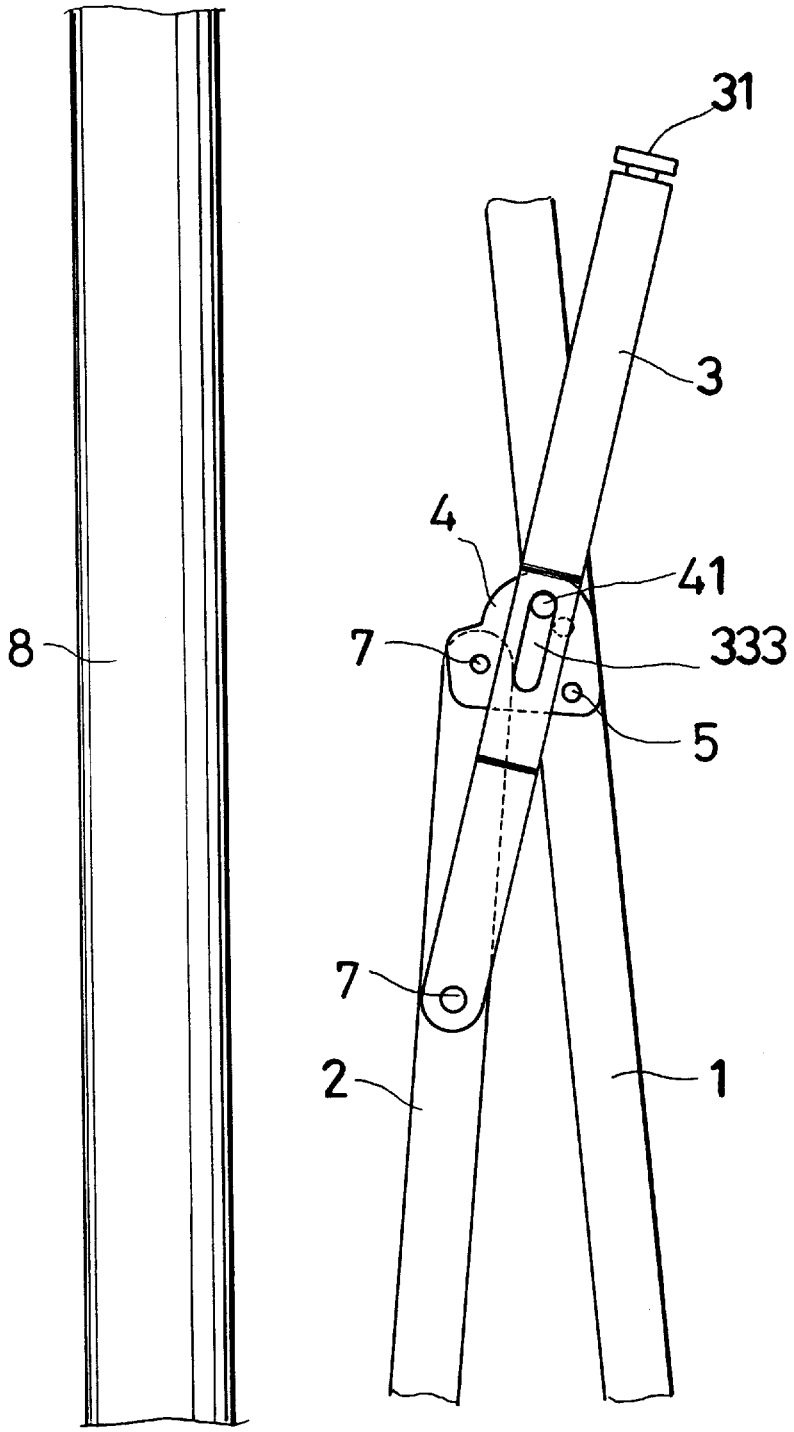
FIG. 3 is a front view of the frame of the umbrella of the present invention.

In assembling, referring to FIGS. 2 and 3, at first two position members 4 are inserted in the recess 331 of each stretcher extension 3, permitting the projection 41 of each position member 4 fit through the slot 333 of each stretcher extension 3. Then each rib 1 is placed in the gap formed between the two position members 4, with fixing means 5 fitting in the fix holes 11 and the holes 42, 43 to assemble the both 1, 3 together. Then a pivot 7 is inserted in the through hole 44 of a position member 4 and the pivot hole 21 of a stretcher 2 to pivotally connect the position member 4 with the stretcher 2. Finally, another pivot 7 is inserted in the pivot hole 334 of an stretcher extension 3 and in the pivot hole 22 of of a stretcher 2 to connect pivotally each stretcher 2 with each stretcher extension Then this assembled frame of the umbrella is assembled with the support rod 8 and the upper panel 6 and the lower panel 6, and 6', finishing assemblage of the umbrella in the present invention, as shown in FIGS. 4, 5 and 6.

Figure 4:
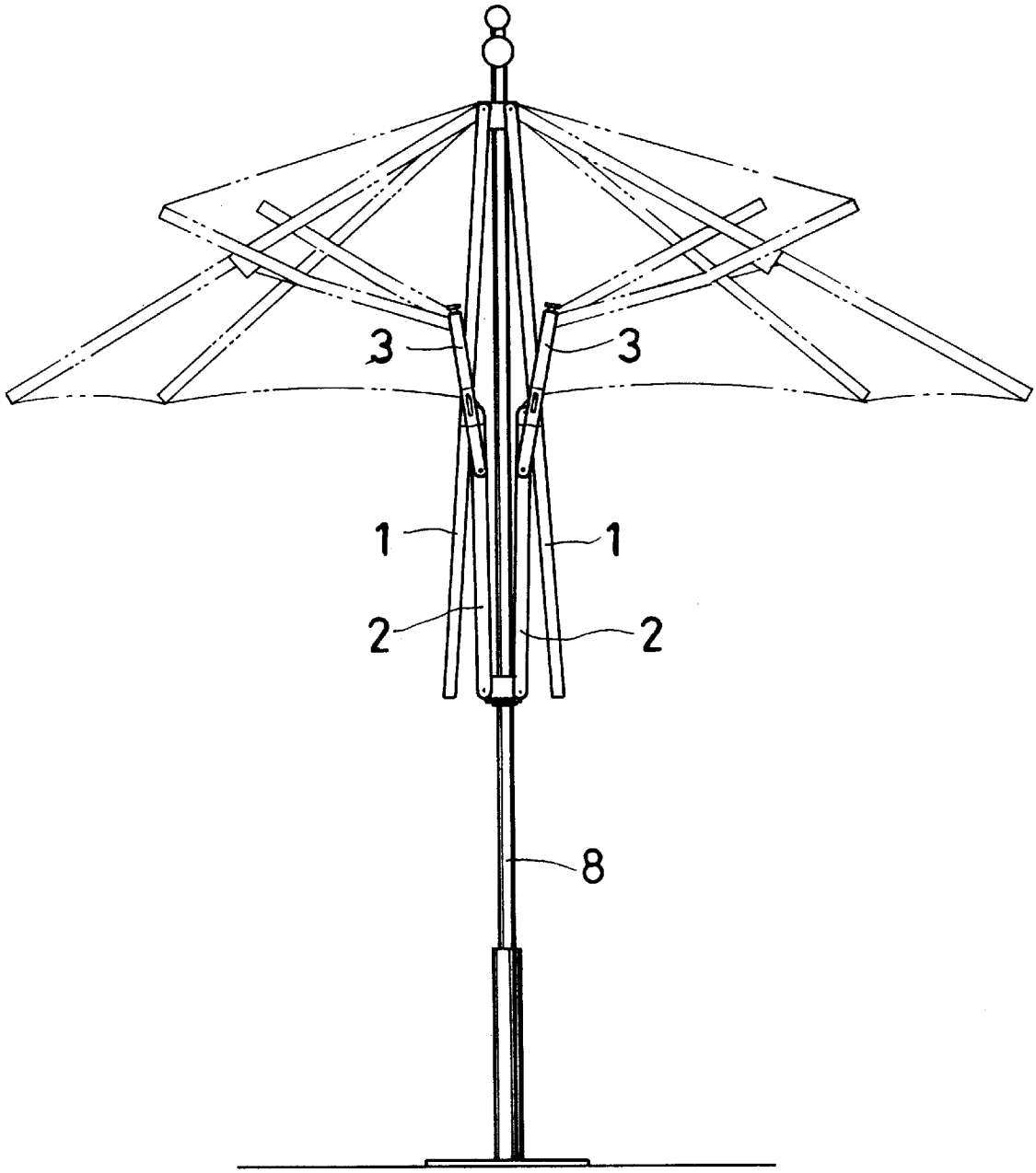
FIG. 4 is front view of the umbrella asol of the present invention, with two panels being to be spread.
Figure 5:
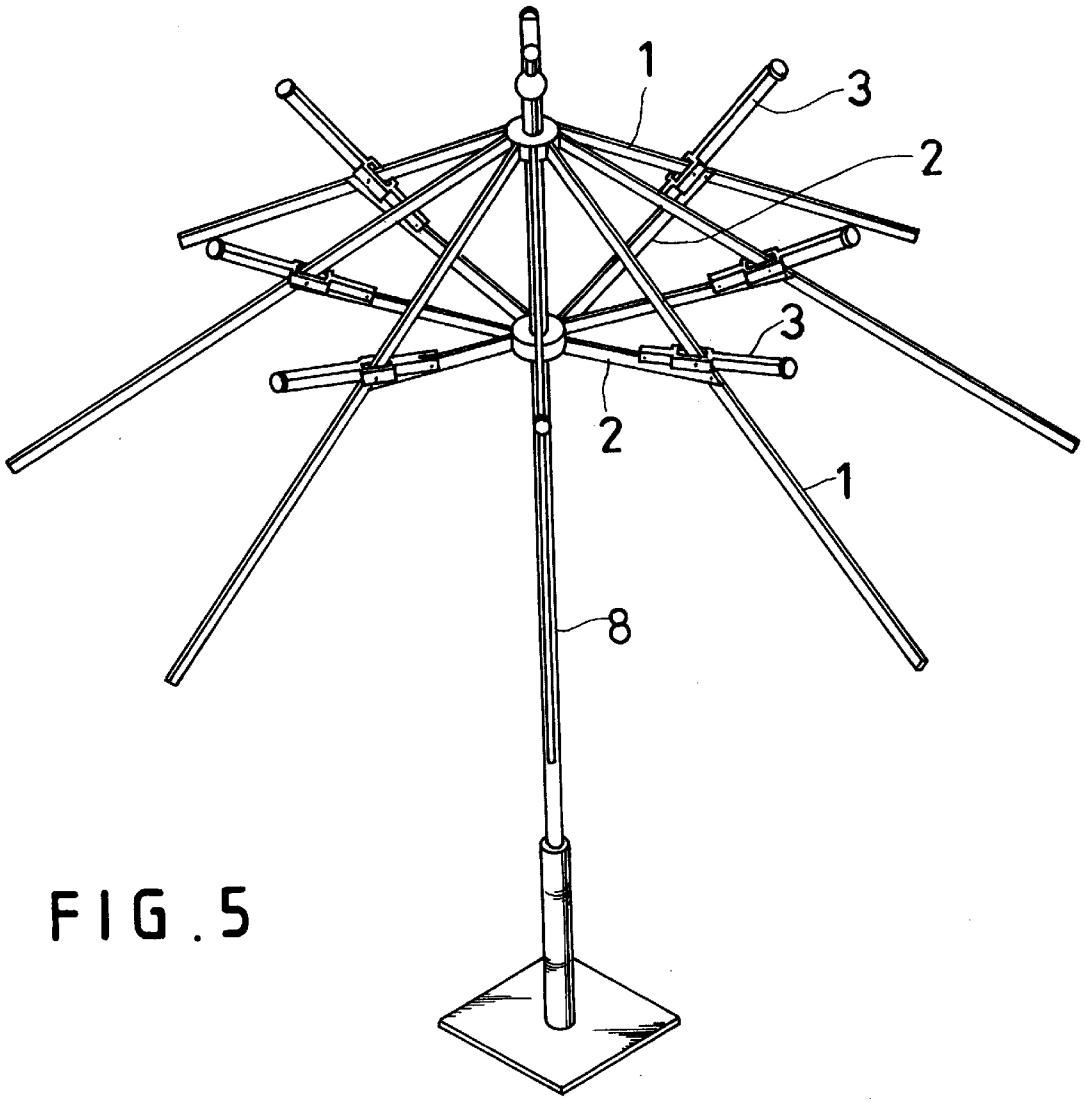
FIG. 5 is a perspective view of an umbrella with the frame spread of the present invention.
Figure 6:
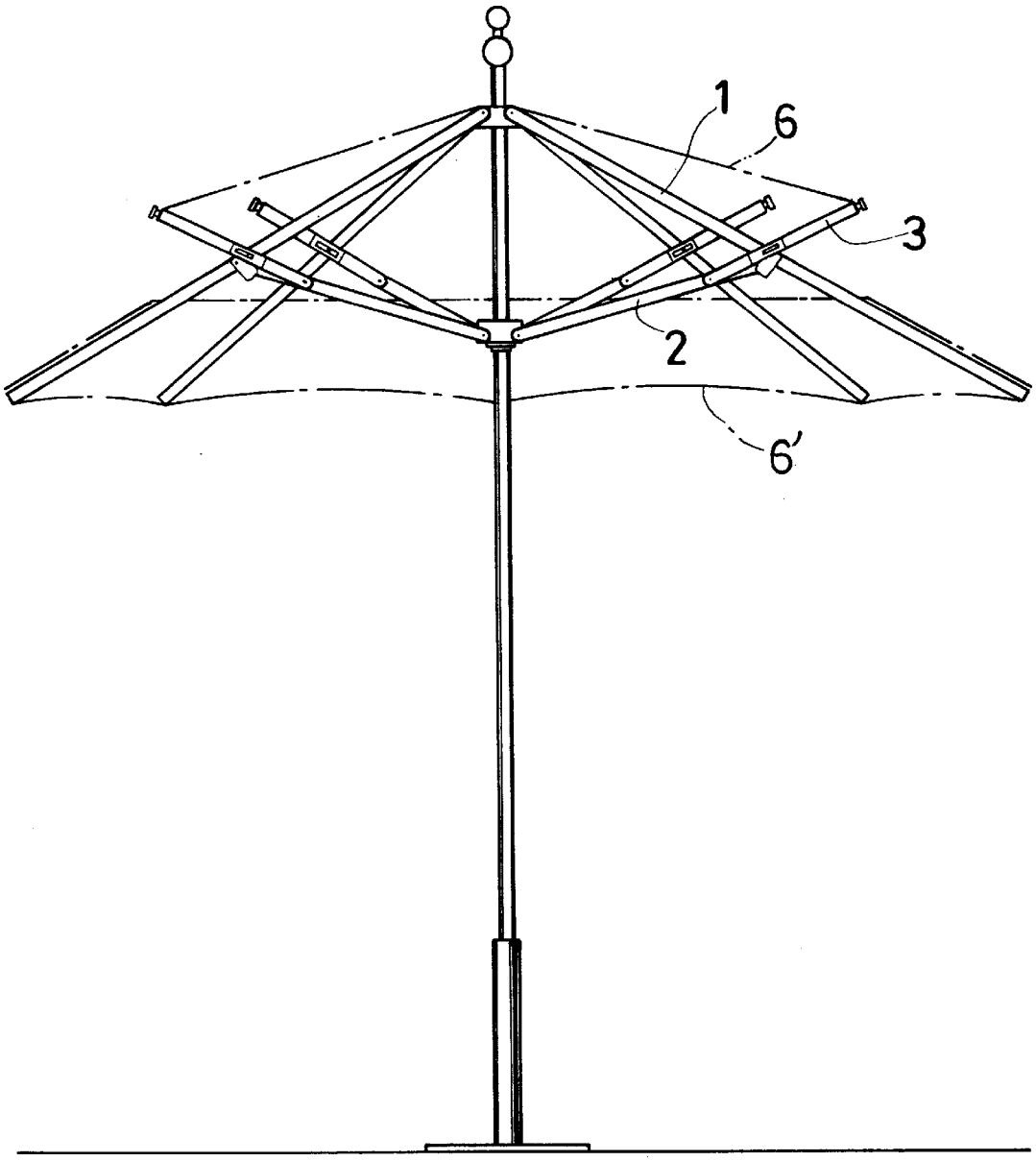
FIG. 6 is a front view of FIG. 5.
Figure 7:
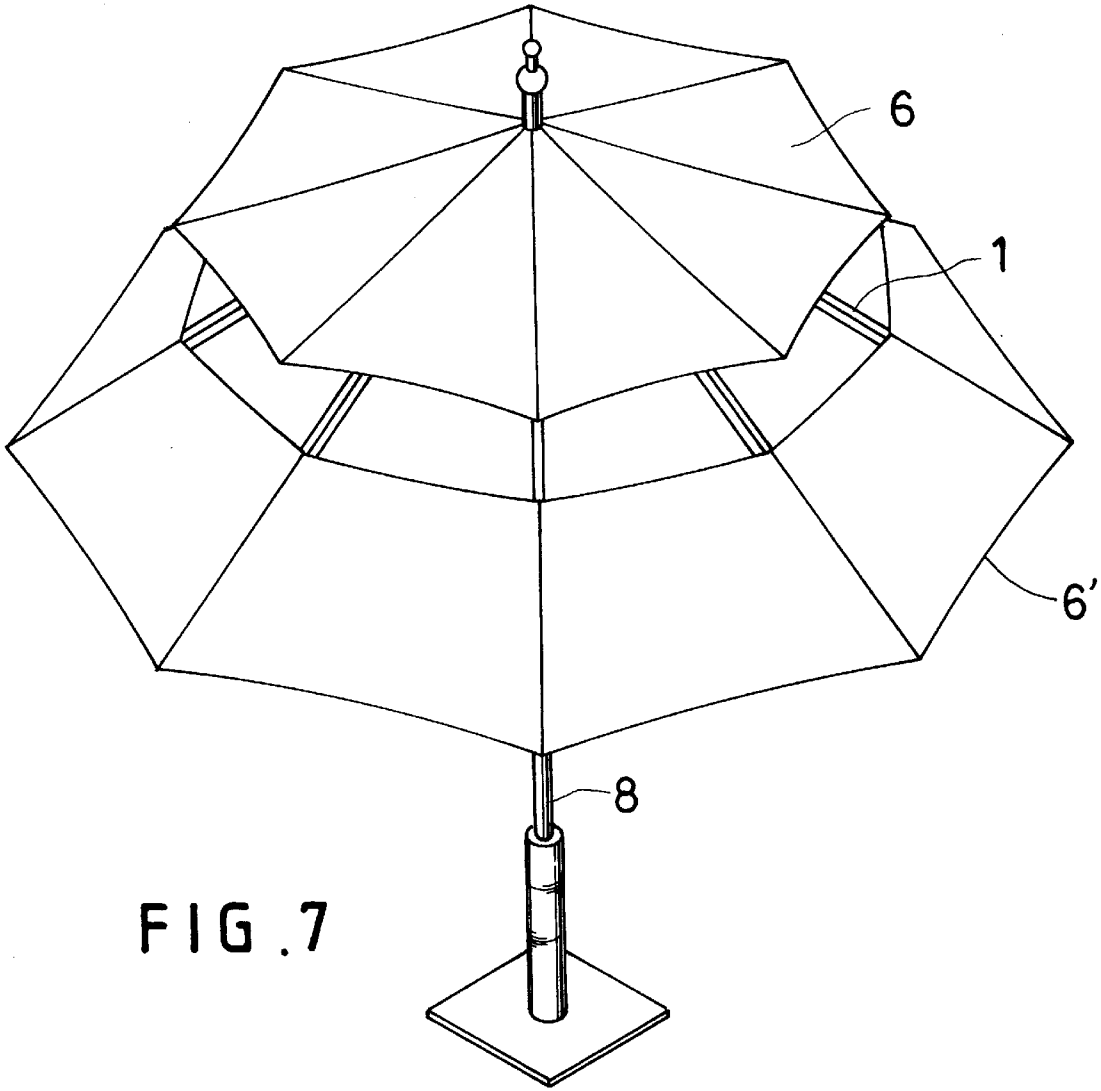
FIG. 7 is a perspective view of the umbrella with the lower panel and the upper panel spread of the present invention; and, FIG. 8 is a perspective view of a conventional umbrella.
Figure 8:
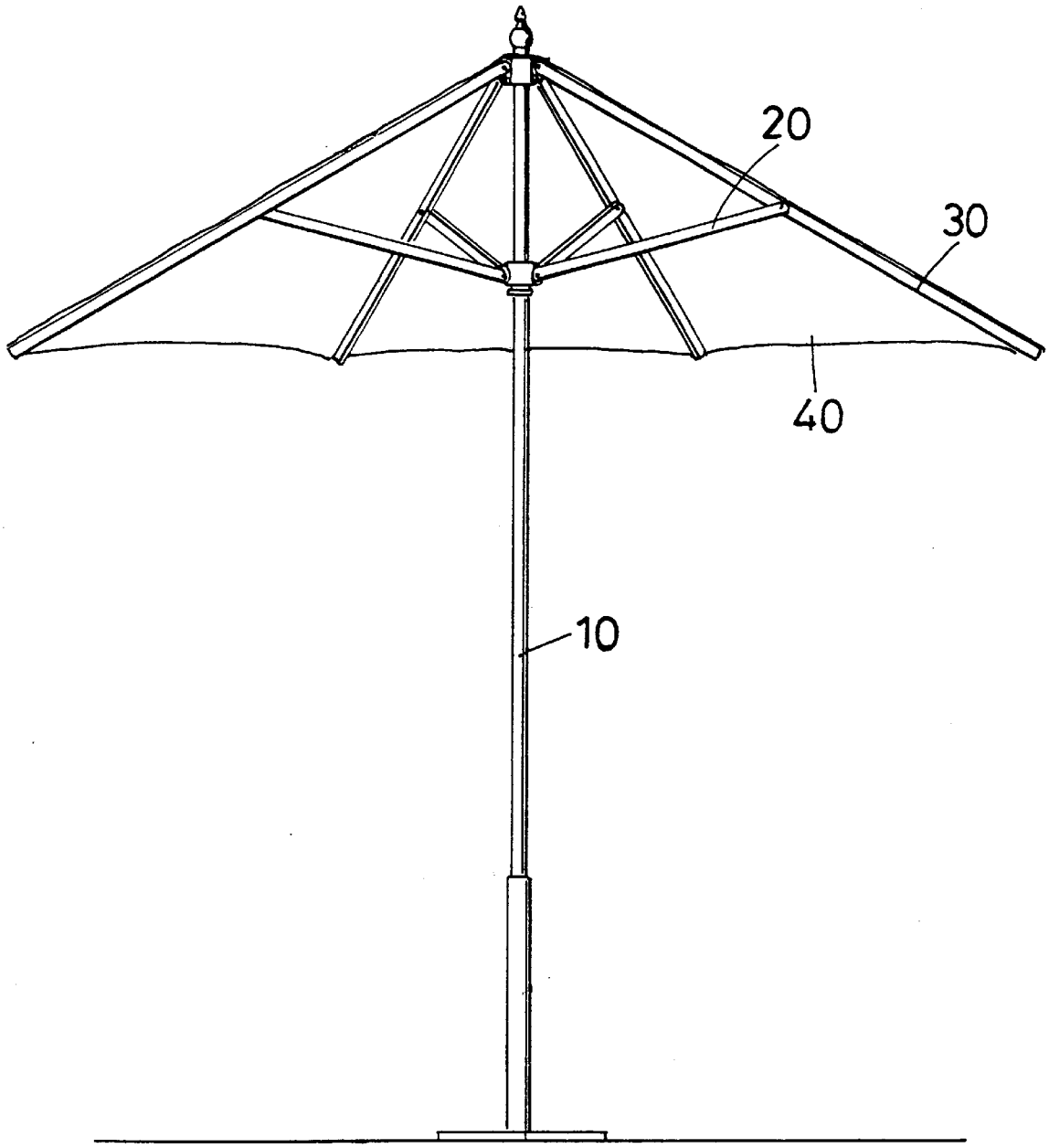
FIG. 8 (PRIOR ART)

When the umbrella is to be spread from a collapsed position shown in FIG. 4, referring to FIGS. 5, 6 and 7, the stretchers 2 are pushed upward relative to the support rod 8, forcing the ribs 1 move up together with the stretcher extensions 3, with the projections 41 of the position members 4 sliding in the slots 333 of the stretchers extensions 3 to move from one ends of the slots 333 to the other ends of the slots 333 until the upper panels 6 and the lower panels 6' are spread to the most opened position, wherein each rib 1 crosses each extension stretcher 3 and an outer portion with a round stud 31 of each stretcher extension 3 is positioned to extend out of each rib 1 as shown in FIG. 5. In this position of the umbrella, there is formed a distance between the outer end, i.e. the round stud 31 of each stretcher extension 3 and the upper end of each rib 1 so that the upper panel 6 may be installed on the area formed between that distance and the lower panel 6' may be installed on the area formed between the cross points of the ribs 1 and the stretcher extensions 3 and the outer ends of the ribs 1. Then a proper gap is formed between the upper panel 6 and the lower panel 6' for a wind to blow through out without blowing the whole umbrella to sway or fall down.

While the preferred embodiment of the invention has been described above, it will be recognized and understood that various modifications may be made therein and the appended claims are intended to cover all such modifications which may fall within the spirit and scope of the invention.

What is claimed is:

1. An umbrella comprising a frame consisting of a number of ribs, a number of stretchers and a number of extension stretchers and a number of position members combined together with pivots and then assembled with a support rod, an upper panel and a lower panel;

each said rib having two fix holes spaced apart vertically in an intermediate portion;

each said stretcher having a pivot hole respectively in an upper end and in an intermediate portion;

each said stretcher extension having a round stud on an upper end, an opening formed in an intermediate portion and a lower portion, two side plate walls formed to defined said opening and respectively having a recess in the intermediate portion to form two opposite projecting-out walls, said two opposite projecting-out walls respectively having a lengthwise slot, said two side plate walls respectively having a pivot hole in a lower end;

each position member shaped as a plate having a projection on an outer side and two round holes in one side and a through hole in the other side; and, each of said position members inserted in said recess of each said stretcher extension, with said projections inserting in said slots of each said stretcher extension, each said rib placed in a gap formed between two of said position members and securing said position members with fixing means fitting in said fix holes of each said rib and said round holes of said position members, one of said pivots connecting each said position member with each said stretcher by fitting in said through hole of said position member and said pivot hole of said stretcher, another of said pivots connecting each said stretcher extension with each said stretcher by inserting in said pivot hole of said stretcher extension and said pivot hole of said stretcher, said frame thus constructed to be assembled with said support rod and slidably to be collapsed from a spread position or vice versa, said combination of said upper panel and said lower panel coupled to said finish frame for preventing collapse of said umbella when a wind force is applied.

* * * * *